US010187740B2

(12) United States Patent Family

(10) Patent No.: US 10,187,740 B2

(45) Date of Patent: Jan. 22, 2019

(54) PRODUCING HEADPHONE DRIVER SIGNALS IN A DIGITAL AUDIO SIGNAL PROCESSING BINAURAL RENDERING ENVIRONMENT

(71) Applicant: Apple Inc., Cupertino, CA (US)

(72) Inventor: Afrooz Family, Emerald Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/275,217

(22) Filed: Sep. 23, 2016

(65) Prior Publication Data

US 2018/0091920 A1 Mar. 29, 2018

(51) Int. Cl.

*H04S 7/00* (2006.01)
*H04S 1/00* (2006.01)
*H04R 5/033* (2006.01)

(52) U.S. Cl.

CPC ..... *H04S 7/304* (2013.01); *H04R 5/033* (2013.01); *H04S 1/005* (2013.01); *H04S 7/306* (2013.01); *H04S 2400/01* (2013.01); *H04S 2420/01* (2013.01)

(58) Field of Classification Search

USPC ..... 381/17, 300, 1, 312

See application file for complete search history.

(56) References Cited

U.S. PATENT DOCUMENTS 7,769,183 B2 8/2010 Bharitkar et al.
8,045,718 B2 10/2011 Faure et al.
8,428,269 B1 4/2013 Brungart et al.
8,768,496 B2 7/2014 Katz et al.
9,107,021 B2 8/2015 Florencio et al.
9,137,619 B2 9/2015 Nackvi (Continued)

FOREIGN PATENT DOCUMENTS

WO WO-2014036121 3/2014
WO WO 2015/066062 A1 * 5/2015

(Continued)

OTHER PUBLICATIONS

Herre, Jurgen, et al., "MPEG-H Audio—The New Standard for Universal Spatial/3D Audio Coding", *Journal of Audio Engineering* vol. 62, No. 12, Dec. 2014., 10 Pages.

(Continued)

*Primary Examiner* — Yogeshkumar Patel

(74) *Attorney, Agent, or Firm* — Womble Bond Dickinson (US) LLP

(57) ABSTRACT

A number of candidate binaural room impulse responses (BRIRs) are analyzed to select one of them as a selected first BRIR that is to be applied to diffuse audio, and another one as a selected second BRIR that is to be applied to direct audio, of a sound program. A first binaural rendering process is performed on the diffuse audio by applying the selected first BRIR and a first head related transfer function (HRTF) to the diffuse audio. A second binaural rendering process is performed on the direct audio by applying the selected second BRIR and a second HRTF to the direct audio. Results of the two binaural rendering processes are combined to produce headphone driver signals. Other embodiments are also described and claimed.

22 Claims, 3 Drawing Sheets

(56) References Cited

U.S. PATENT DOCUMENTS

2003/0007648 A1* 1/2003 Currell ..... H04S 7/30 381/61
2006/0165247 A1* 7/2006 Mansfield ..... H04S 3/002 381/307
2007/0071249 A1 3/2007 Reining et al.
2007/0100605 A1* 5/2007 Renevey ..... G10L 21/0272 704/201
2007/0297616 A1* 12/2007 Plogsties ..... H04S 3/004 381/23
2009/0060236 A1* 3/2009 Johnston ..... H04R 3/12 381/304
2010/0061558 A1* 3/2010 Faller ..... G10L 19/008 381/23
2012/0057715 A1* 3/2012 Johnston ..... G10L 19/008 381/63
2012/0076308 A1* 3/2012 Kuech ..... H04M 9/082 381/22
2012/0314876 A1* 12/2012 Vilkamo ..... G10L 19/008 381/22
2013/0016842 A1* 1/2013 Schultz-Amling ... G10L 19/173 381/17
2013/0022206 A1* 1/2013 Thiergart ..... G10L 19/008 381/17
2013/0142341 A1* 6/2013 Del Galdo ..... G10L 19/008 381/23
2013/0182852 A1* 7/2013 Thompson ..... H04R 5/04 381/17
2013/0272526 A1* 10/2013 Walther ..... H04S 3/008 381/1
2014/0177857 A1* 6/2014 Kuster ..... H04R 25/407 381/66
2015/0189436 A1* 7/2015 Kelloniemi ..... H04S 7/30 381/98
2015/0223002 A1* 8/2015 Mehta ..... H04S 7/30 381/303
2015/0249899 A1* 9/2015 Kuech ..... H04S 7/30 381/18
2015/0350801 A1* 12/2015 Koppens ..... H04S 1/005 381/1
2015/0358754 A1* 12/2015 Koppens ..... H04S 1/005 381/17
2016/0029138 A1* 1/2016 France ..... G10L 19/008 381/23
2016/0057556 A1* 2/2016 Boehm ..... G10L 21/02 381/23
2016/0119734 A1* 4/2016 Sladeczek ..... H04R 29/005 381/26
2016/0142854 A1* 5/2016 Fueg ..... H04S 3/004 381/22
2016/0174013 A1* 6/2016 Pallone ..... H04S 1/005 381/1
2016/0192105 A1 6/2016 Breebaart et al.
2016/0212564 A1* 7/2016 Fontana ..... G10L 19/008
2016/0225377 A1* 8/2016 Miyasaka ..... G10L 19/008
2016/0255453 A1* 9/2016 Fueg ..... G10L 19/008 381/1
2016/0266865 A1* 9/2016 Tsingos ..... H04S 7/304
2016/0293179 A1* 10/2016 Thiergart ..... H04R 3/005
2016/0337779 A1* 11/2016 Davidson ..... H04S 7/304
2016/0365100 A1* 12/2016 Helwani ..... G10L 21/0208
2017/0078819 A1* 3/2017 Habets ..... H04S 7/30
2017/0078820 A1* 3/2017 Brandenburg ..... H04S 7/304
2017/0094438 A1* 3/2017 Chon ..... H04S 5/005
2017/0134876 A1* 5/2017 Thiergart ..... G10L 19/008
2017/0365262 A1* 12/2017 Miyasaka ..... G10L 19/008
2018/0035233 A1* 2/2018 Fielder ..... H04S 3/004
2018/0077511 A1* 3/2018 Mehta ..... H04S 7/30
2018/0151186 A1* 5/2018 Mehta ..... G10L 19/008

FOREIGN PATENT DOCUMENTS

WO WO-2015066062 5/2015
WO WO-2015102920 7/2015

OTHER PUBLICATIONS

Johnston, James D., et al., "Beyond Coding: Reproduction of Direct and Diffuse Sounds in Multiple Environments", *Presented at the 129th Convention for Audio Engineering Society*, Convention Paper 8314, San Francisco, California, Nov. 4-7, 2010., 9 Pages.
Jot, Jean-Marc, et al., "Approaches to binaural synthesis", *Presented at the 105th Convention of Audio Engineering Society*, San Francisco, California. Sep. 26-29, 1998., 14 Pages.
Menzer, Fritz, et al., "Obtaining Binaural Room Impulse Responses From B-Format Impulse Responses Using Frequency-Dependent Coherence Matching", *IEEE Transactions on Audio, Speech, and Language Processing*, vol. 19, No. 2, pp. 396-405., (Feb. 1, 2011).
Sunder, Kaushik, et al., "Natural Sound Rendering for Headphones", *DSP Lab, School of EEE, Nanyang Technological University*, Singapore, 31 Pages.
International Search Report and Written Opinion, dated Nov. 24, 2017, Application No. PCT/US2017/047598.

* cited by examiner

PRODUCING HEADPHONE DRIVER SIGNALS IN A DIGITAL AUDIO SIGNAL PROCESSING BINAURAL RENDERING ENVIRONMENT

FIELD

An embodiment of the invention relates to the playback of digital audio through headphones, by producing the headphone driver signals in a digital audio signal processing binaural rendering environment. Other embodiments are also described.

BACKGROUND

A conventional approach for listening to a sound program or digital audio content, such as the sound track of a movie or a live recording of an acoustic event, through a pair of headphones is to digitally process the audio signals of the sound program using a binaural rendering environment (BRE), so that a more natural sound (containing spatial cues, thereby being more realistic) is produced for the wearer of the headphones. The headphones can thus simulate an immersive listening experience, of "being there" at the venue of the acoustic event. A conventional BRE may be composed of a chain of digital audio processing operations (including linear filtering) that are performed upon an input audio signal, including the application of a binaural room impulse response (BRIR) and a head related transfer function (HRTF), to produce the headphone driver signal.

SUMMARY

Sound programs such as the soundtrack of a movie or the audio content of a video game are complex in that they having various types of sounds. Such sound programs often contain both diffuse audio and direct audio. Diffuse audio are audio objects or audio signals that produce sounds which are intended to be perceived as not originating from a single source, as being "all around us" or spatially large, e.g., rainfall noise, crowd noise. In contrast, direct audio produces sounds that appear to originate from a particular direction, e.g. voice. An embodiment of the invention is a technique for rendering diffuse audio and direct audio in a binaural rendering environment (BRE) for headphones, so that the headphones produce a more realistic listening experience when the sound program is complex and thus has both diffuse and direct audio content. Differently configured binaural rendering processes are performed, upon the diffuse audio and upon the direct audio, respectively. The two binaural rendering processes may be configured as follows. A number of candidate BRIRs have been computed or measured, and are stored. These are then analyzed and categorized based on multiple metrics including room acoustic measures derived from the BRIRs (including T60, lateral/direct energy ratio, direct/reverberant energy ratio, room diffusivity, and perceived room size), finite impulse response, FIR, digital filter length and resolution, geolocation tags, as well as human or machine generated descriptors based on subjective evaluation (e.g., does a room sound big, intimate, clear, dry, etc.). The latter, qualitative classification can be performed using machine learned algorithms operating on the room acoustics information gathered for each BRIR. In this manner, the N BRIRs may be separated into several categories, including a category that is suitable for application to diffuse audio and another category that is suitable for application to direct audio. A BRIR is then selected from the diffuse category and applied by a binaural rendering process to the diffuse content, while another BRIR is selected from the direct category and applied by another binaural rendering process to the direct content. The selection of these two BRIRs may be based on several criteria. For example, in the case of rendering direct signals, it may be desirable to select a BRIR that has a "short" T60 and well-controlled early reflections. For rendering ambient content, a selected BRIR may be preferred that represents a larger more diffuse room with fewer localizable reflections. Furthermore, when selecting BRIRs, special consideration may be given to the type of program material to be rendered. Speech-dominated content (for example, podcasts, audio books, talk radio) may be rendered using a selected BRIR that represents a drier room than would be used to render pop music. As such, the selected BRIR should be deemed to be "better" than the others for enhancing its respective type of sounds. The results of the diffuse and direct binaural rendering processes are then combined, into headphone driver signals.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the connections between and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
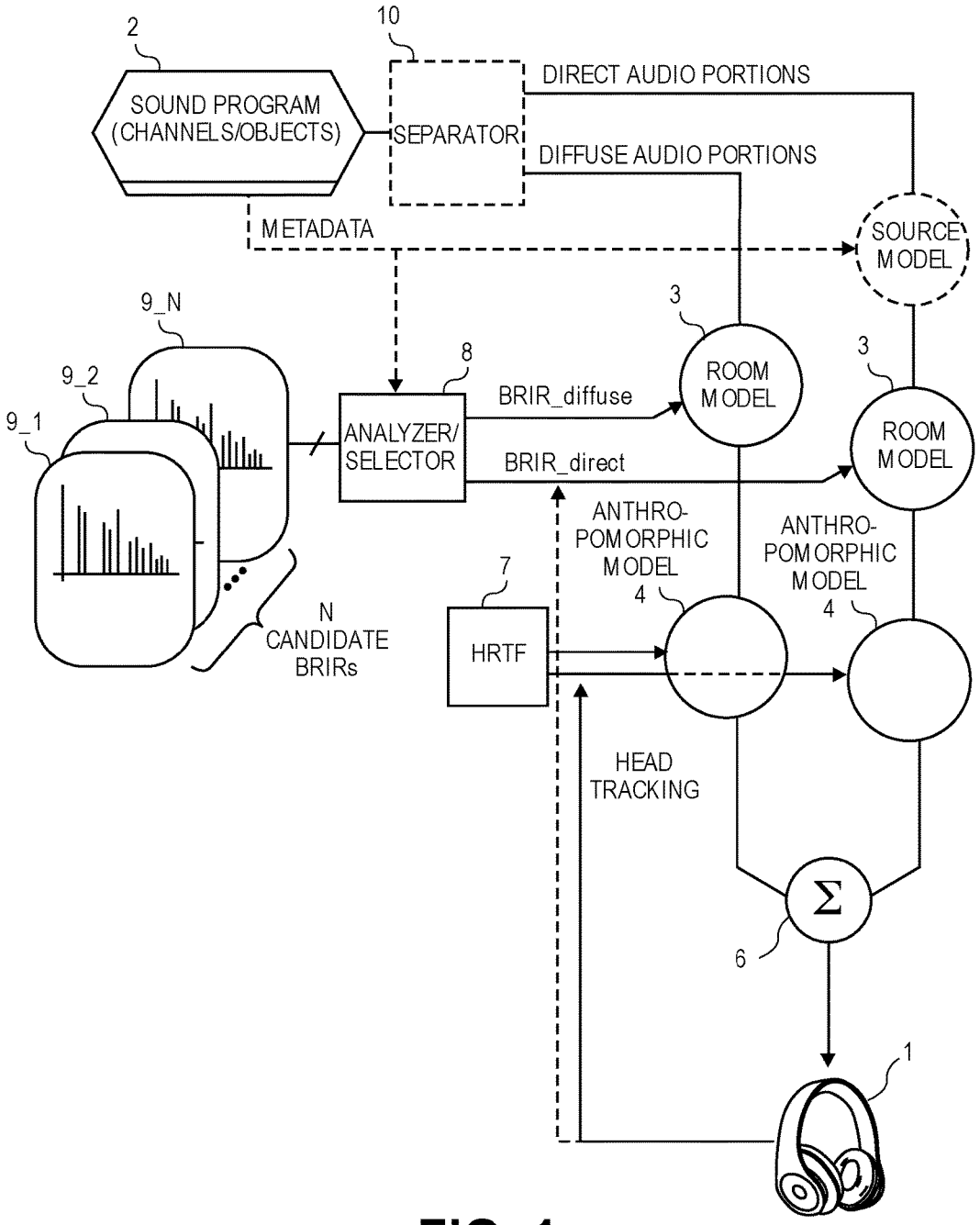
FIG. 1 is a block diagram of an audio playback system having a BRE.

FIG. 1 is a block diagram of an audio playback system having a BRE. The block diagrams here may also be used to describe methods for binaural rendering of a sound program. A pair of headphones 1 is to receive a left driver signal and a right driver signal that have been digitally processed by the BRE in order to produce a more realistic listening experience for the wearer, despite the fact that the sound is produced by only head-worn speaker drivers, for example in left and right ear cups. The headphones 1 may be as unobtrusive as a pair of inside-the ear earphones (also referred to as ear buds), or they may be integrated within a larger head worn device such as a helmet. The audio content to be rendered for the headphones 1 originates within a sound program 2, which contains digital audio formatted as multiple channels and/or objects (e.g., at least two channels or left and right stereo, 5.1 surround, and MPEG-4 Systems Specification.) The sound program 2 may be in the form of a digital file that is stored locally (e.g., within memory 21 of a media player device 20—see the example in FIG. 4 described below) or a file that is streaming into the system from a server, over the Internet. The audio content in the sound program 2 may represent music, the soundtrack of a movie, or the audio portion of live television (e.g., a sports event.)

Figure 2:
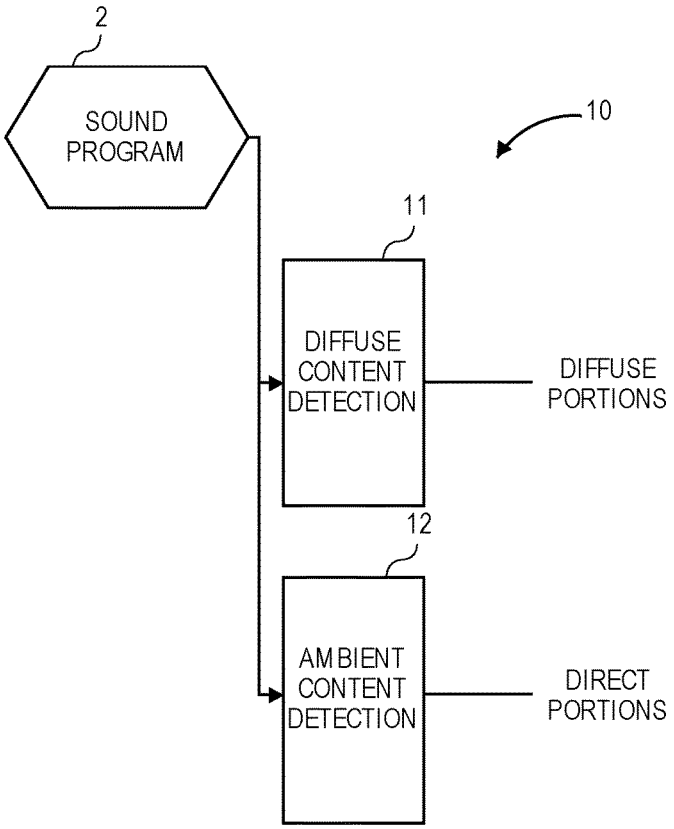
FIG. 2 is a block diagram of a separator used in the BRE that serves to analyze a sound program so as to detect diffuse and ambient portions therein.

Referring to FIG. 1 still, an indication of diffuse audio, and an indication of direct audio in the sound program 2 are also received. The direct audio contains voice, dialogue or commentary, while the diffuse audio is ambient sounds such as the sound of rainfall or a crowd. The indications may, in one embodiment, be part of metadata associated with the sound program 2, which metadata may also be received from a remote server for example through a bitstream, e.g., multiplexed with the digital audio signal that contains diffuse and direct audio portions in the same bitstream, or provided as a side-channel. Alternatively, the direct and diffuse portions of the sound program 2 (also referred to as the diffuse audio and direct audio) may be obtained by a separator 10 that processes the sound program 2 in order to detect and extract or derive the diffuse components—see FIG. 2 in which a diffuse content detection block 11 serves such a purpose, while a direct content detection block 12 separates out the direct components.

As seen in FIG. 1, the BRE has two routes or paths, and these paths may operate in parallel, e.g., operating on different portions of the same sound program 2 that is being played back, which portions may also overlap each other in time. The BRE operates on the direct and diffuse portions as these become available during playback. Each of the paths applies a room model 3 and an anthropomorphic model 4, which are digital signal processing stages that process the respective direct or diffuse portions as part of what is referred to here as binaural rendering processes, respectively, to produce their respective first and second intermediate (digital audio) signals. In one embodiment, a first pair of intermediate signals intended for the left and right drivers of the headphones 1, respectively, and a second pair of intermediate signals intended for the left and right drivers, respectively, are produced. These intermediate signals are combined (e.g., summed, by a summer 6), to produce a pair of headphone driver signals that are to drive the left and right speaker drivers, respectively, of the headphones 1. For example, the first, left intermediate signal is combined with the second, left intermediate signal, while the first, right intermediate signal is combined with the second, right intermediate signal (both by the summer 6.)

The processing or filtering of the diffuse audio content, which is performed by the application of the room model 3, includes convolving the diffuse content with a BRIR_diffuse which is a BRIR that is suitable for diffuse content. Similarly, the processing or filtering of the direct audio content is also performed by applying the room model 3, except in that case the direct content is convolved with a BRIR_direct, which is a BRIR that is more suitable for direct content than for diffuse content.

As for processing or filtering of the diffuse and direct audio contents using anthropomorphic models 4, both paths may convolve their respective audio content with the same head related transfer function (HRTF 7.) The HRTF 7 may be computed in a way that is specific or customized to the particular wearer of the headphones 1, or it may have been computed in the laboratory as a generic version that is a "best fit" to suit a majority of wearers. In another embodiment, however, the HRTF 7 applied in the diffuse path is different than the one applied in the direct path, e.g., the HRTF 7 that is applied in the direct path may be modified and repeatedly updated during playback, in accordance with head tracking of the wearer of the headphones 1 (e.g., by tracking of the orientation of the headphones 1, using for example output date of an inertial sensor that is built into the headphones 1.) Note that the head tracking may also be used to modify (and repeatedly update) the BRIR_direct, during the playback. In one embodiment, the HRTF 7 and the BRIR_diffuse that are being applied in the diffuse path need not be modified in accordance with the head tracking, because the diffuse path is configured to be responsible for only processing the diffuse portions (that lead to sound that is to be experienced by the wearer of the headphones 1 as being all around or completely enveloping the wearer, rather than coming from a particular direction.)

Still referring to FIG. 1, the first and second binaural rendering processes that are performed on the diffuse and direct audio portions, respectively, each receive their respective BRIR from an analyzer/selector 8. The latter analyzes a number (N>1) of candidate BRIRs 9_1, 9_2, . . . 9_N to select one of these as a selected first BRIR (BRIR_diffuse), and another one as a selected second BRIR (BRIR_direct.) The first binaural rendering process then applies the selected first BRIR and a first HRTF 7 to the diffuse audio, while the first binaural rendering process applies the selected second BRIR and a second HRTF 7 to the direct audio (noting as above that the HRTF 7 applied to the direct audio may be modified and updated in accordance with head tracking of the wearer of the headphones 1.

Figure 3:
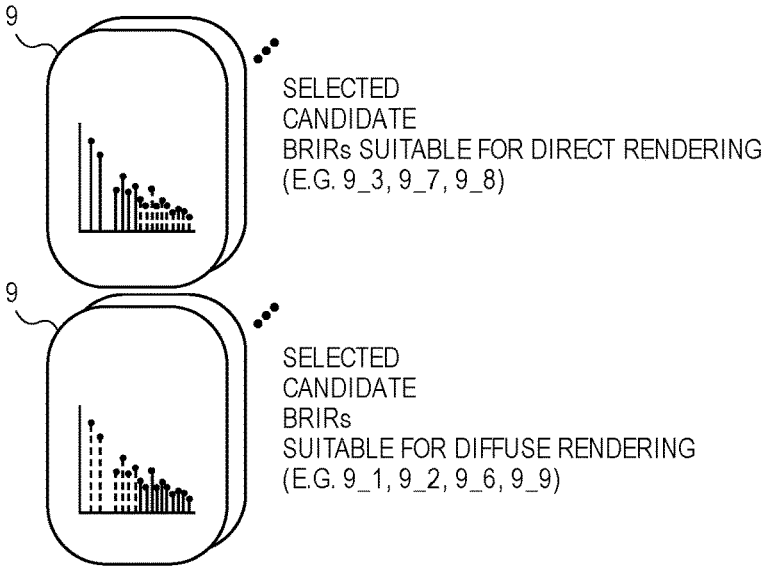
FIG. 3 shows the results of analysis upon candidate BRIRs, as selections of candidates that are suitable for direct rendering and selections of candidates that are suitable for diffuse rendering.

FIG. 3 shows the results of the analysis upon the N candidate BRIRs. As an example, the candidate BRIRs 9_3, 9_7 and 9_8 have been selected or classified as being more suitable for the direct content rendering path, while the candidate BRIRs 9_1, 9_2, 9_6 and 9_9 are selected or classified as being more suitable for the diffuse content rendering path. In one embodiment, the analysis of the N candidate BRIRs proceeds as follows. As also pointed out above in the Summary section, the BRIRs may be analyzed or measured using multiple metrics, including for example at least two of the following: direct/reverberant ratio, virtual room geometry, source directivity (both along azimuth and elevation), diffusivity, distance to first reflections, and direction of first reflections. In addition, reflectograms can be can produced, from all of the available BRIRs, showing the angle and intensity of all early reflections (for analysis.) These BRIRs may then be classified, by examining their metrics and grouping multiple attributes together. Example classifications or BRIR types include: large dry rooms, small rooms with omnidirectional sources, diffuse rooms with average T60s, etc. Then, these BRIR types may be associated with types of content (movie dialog, sound effects, background audio, alerts and notifications, music, etc.)

In one embodiment, analysis of the candidate BRIRs (to select the selected first and second BRIRs) involves the following: analyzing the BRIR to classify room acoustics of the BRIR, e.g., does the BRIR represent a large dry room, a small room with omnidirectional sources, or a diffuse room with average T60s. In addition, room geometry may be extrapolated from the BRIR, e.g., does the BRIR represent a room with smooth rounded walls, or a rectangular room. Also, sound source directivity or other source information may be extracted from the BRIR. In connection with the latter, it should be recognized that all BRIRs measure a playback source that is placed in a room (measured binaurally—usually for example a head and torso simulator, HATS). Not only does the room play a major part in the BRIR, but also the type of source (loudspeaker) used in the measurement. Thus, a BRIR may be viewed as a measurement that tracks how a listener would perceive a sound source interacting with a given room. For example, implicit in this interaction between sound source and room, are characteristics of both the room, but also the sound source. It is possible that specific direct and diffuse BRIRs can be generated, and that when doing so one should optimize the characteristics of the sound source. When producing a direct BRIR, a highly directive sound source may be desirable. Conversely, when producing a diffuse BRIR, it may be advantageous to measure the BRIR while using a sound source with a negative directivity index (DI), in order to attenuate as much direct energy as possible.

Still referring to FIG. 3, in one embodiment, the N candidate BRIRs 9 include some that have early reflection room impulse responses (early responses), and some that have late reflection room impulse responses (late responses). The signal or content in each of the early responses is predominantly direct and early reflections, e.g., reflections of sound off of a surface in a room that occur early in an interval between when the sound is emitted by its source and when it is still being heard by a listener (in the room.) In contrast, the signal or content in each of the late responses is predominantly late reverberation (or late field reflections), e.g., due to reflections from other surfaces in the room that occur late in the interval. The late response may be characterized as having a normal or Gaussian probability distribution or one in which the peaks are uniformly mixed. These characteristics of early and late responses may be used as a basis for selecting one of the candidate BRIRs as the BRIR_direct, and another as the BRIR_diffuse. For example, as illustrated in FIG. 3, the selected candidate BRIRs 9_3, 9_7 and 9_8 that are suitable for direct rendering (BRIR_direct) include only early responses, where the dotted lines shown represent the absence of the reverberation field in each of the room impulse responses. The selected candidate BRIRs 9_1, 9_2, 9_6 and 9_9 that are suitable for diffuse rendering include only late responses, where the dotted lines shown there represent the absence of direct and early reflections in each room impulse response.

In another embodiment, the N candidate BRIRs 9 include one or more early reflection room impulse responses, and one or more late reflection room impulse response, where in this case a late reflection room impulse response is associated with a room that is larger than the room that is associated with an early reflection room impulse response.

In another embodiment, the analysis and classification of the candidate BRIRs includes: classifying number of channels or objects in the sound program that is being processed by the first and second binaural rendering processes, finding correlation between audio signal segments of the sound program over time, and extraction of metadata associated with the sound program including genre of the sound program. This is done so as to produce information about the type of content in the sound program. This information is then matched with one or more of the candidate BRIRs that have been classified as being appropriate for that type of content (based on the metrics described earlier.)

Figure 4:
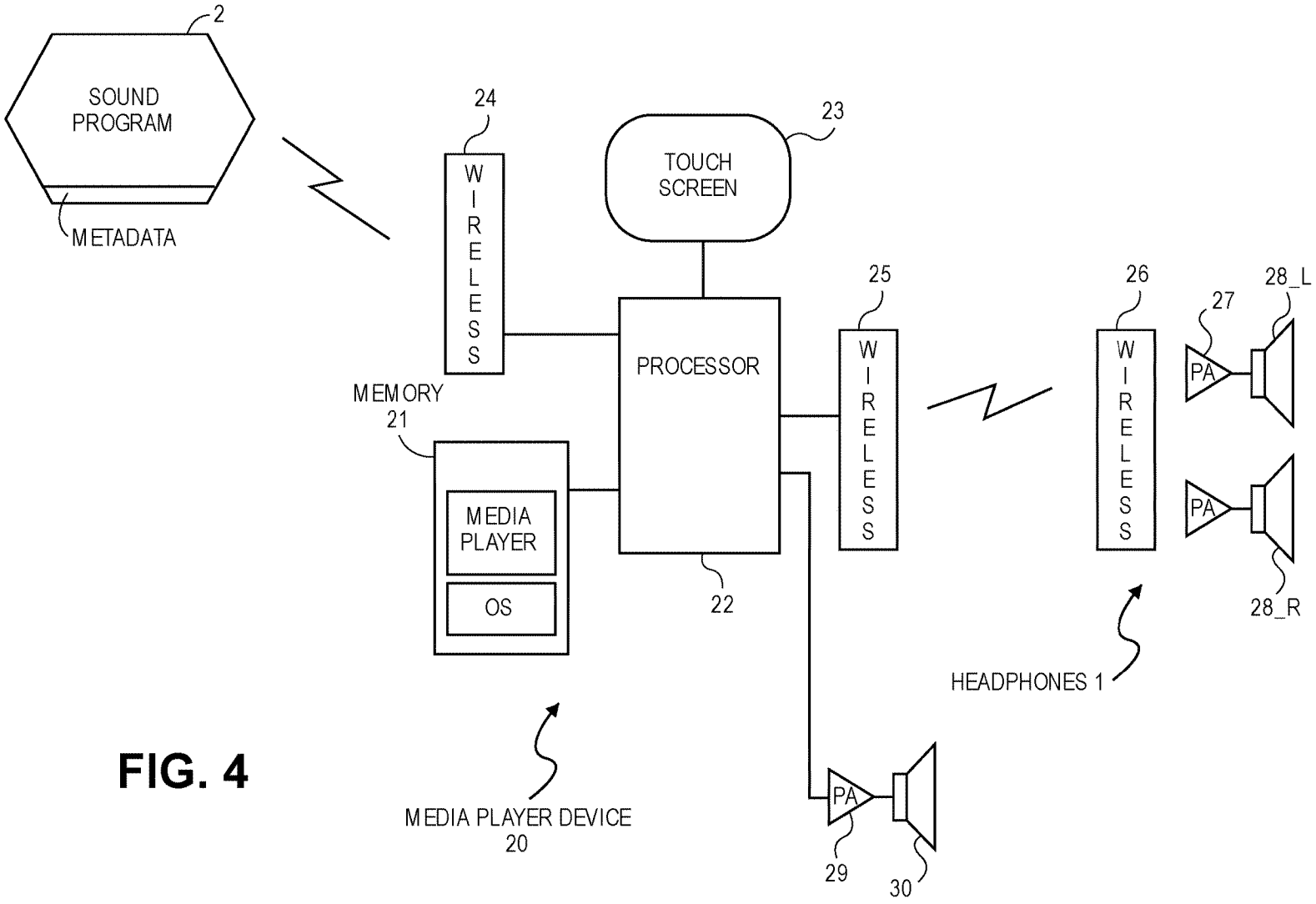
FIG. 4 is a block diagram of an audio playback system in which a media player device running a BRE has a wireless interface to the headphones.

FIG. 4 is a block diagram of an audio playback system in which a media player device 20 is configured as a BRE, in accordance with any of the embodiments described above, to produce headphone driver signals for playback of the sound program 2. The headphone driver signals are produced in digital form by a processor 22, e.g., an applications processor or a system on a chip (SoC), that is configured into the analyzer/selector 8, the summing unit 6, and applies the room model 3 and anthropomorphic model 4, by executing instructions that are part of a media player program that is running on top of an operating system program, OS. The OS, the media player program (which may include the N candidate BRIRs), and the sound program 2 are stored in a memory 21 (e.g., solid state memory) of the media player device 20. The latter may be a consumer electronics device such as a smartphone, a tablet computer, a desktop computer, or a home audio system, and may have a touch screen 23 through which the processor 22, while executing a graphical user interface program stored in the memory 21 (not shown), may present the wearer of the headphones 1 a control panel through which the wearer may control the selection and playback of the music file or movie file that contains the sound program 2. Alternatively, the selection and playback of the file may be via a voice recognition-based user interface program, which processes the wearer's speech into selection and playback commands, where the speech is picked up by a microphone (not shown) that is in the media player device 20 or that is in a headset that contains the headphones 1.

The media player device 20 may receive the sound program 2 and its metadata through an RF digital communications wireless interface 24 (e.g., a wireless local area network interface, a cellular network data interface) or through a wired interface (not shown) such as an Ethernet network interface. The headphone driver signals are routed to the headphones 1 through another wireless interface 25 that links with a counterpart, headphone-side wireless interface 26. The headphones 1 have a left speaker driver 28L and a right speaker driver 28R that are driven by their respective audio power amplifiers 27 whose inputs are driven by the headphone-side, wireless interface 26. Examples of such wireless headphones include infrared headphones, RF headphones, and BLUETOOTH headsets. An alternative is to use wired headphones, where in that case the wireless interface 25, the headphone-side wireless interface 26, and the power amplifiers 27 in FIG. 4 may be replaced with a digital to analog audio codec and a 3.5 mm audio jack (not shown) that are in a housing of the media player device 20.

It should be noted that the media player device 20 may or may not also have an audio power amplifier 29 and a loudspeaker 30, e.g., as a tablet computer or a laptop computer would. Thus, if the headphones 1 become disconnected from the media player device 20, then the processor 22 could be configured to automatically change its rendering of the sound program 2 so as to suit playback through the power amplifier 29 and the loudspeaker 30, e.g., by omitting the BRE depicted in FIG. 1 and re-routing the resulting speaker driver signals to the power amplifier 29 and the loudspeaker 30.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, while FIG. 4 depicts the media player device 20 as being separate from the headphones 1, with the examples given above including a smartphone, a tablet computer, and a desktop computer, an alternative there is to integrate at least some of the components of the media player device 20 into a single headset housing along with the headphones 1 (e.g., omitting the touch screen and relying instead on a voice recognition based user interface), or into a pair of left and right tethered ear buds, thereby eliminating the wireless interfaces 25, 26. The description is thus to be regarded as illustrative instead of limiting.

What is claimed is:

1. A method for rendering a sound program in a binaural rendering environment for headphones, comprising:

receiving an indication of diffuse audio in a sound program;

receiving an indication of direct audio in the sound program;

analyzing a plurality of candidate binaural room impulse responses (BRIRs) to determine a BRIR suitable for diffuse content and another BRIR suitable for direct content;

selecting the BRIR suitable for diffuse content as a selected first BRIR, and selecting the BRIR suitable for direct content as a selected second BRIR;

performing a first binaural rendering process on the diffuse audio to produce a plurality of first intermediate signals, wherein the first binaural rendering process applies the selected first BRIR and a first head related transfer function (HRTF) to the diffuse audio;

performing a second binaural rendering process on the direct audio to produce a plurality of second intermediate signals, wherein the second binaural rendering process applies the selected second BRIR and a second HRTF to the direct audio; and summing the first and second intermediate signals to produce a plurality of headphone driver signals that are to drive the headphones.

2. The method of claim 1 wherein the diffuse audio and the direct audio overlap each other over time, in the sound program.

3. The method of claim 2 wherein the first and second binaural rendering processes are performed in parallel.

4. The method of claim 1 further comprising receiving metadata associated with the sound program, wherein the metadata contains the indications of the diffuse and direct audio in the sound program.

5. The method of claim 1 wherein analyzing the plurality of candidate BRIRs to select the selected first and second BRIRs comprises: classifying room acoustics of the BRIR, extrapolating room geometry, and extracting source directivity information.

6. The method of claim 1 wherein the plurality of candidate BRIRs comprise a plurality of early reflection impulse responses and a plurality of late reflection impulse responses, wherein content of each of the early reflection impulses response is predominantly direct and early reflections, and content of each of the late reflection impulse responses is predominantly late reverberation.

7. The method of claim 1 wherein the plurality of candidate BRIRs comprise a plurality of early reflection impulse responses and a plurality of late reflection impulse responses, wherein one of the plurality of late reflection impulse responses is associated with a room that is larger than a room that is associated with one of the early reflection impulse responses.

8. The method of claim 1 wherein performing the second binaural rendering process to produce the second intermediate signals further comprises processing the direct audio in accordance with a source model when producing the second intermediate signals, wherein the source model specifies directivity and orientation of a sound source that would produce the sound represented by the direct audio and is independent of room characteristics.

9. The method of claim 1 wherein the direct audio is voice, dialogue or commentary, and the diffuse audio is ambient sounds.

10. The method of claim 1 further comprising head tracking of a wearer of the headphones, wherein the second HRTF is updated based on the head tracking but the first HRTF is not updated based on the head tracking.

11. An audio playback system comprising:

a processor; and memory having stored therein a plurality of candidate binaural room impulse responses (BRIRs), and instructions that when executed by the processor receive an indication of diffuse audio in a sound program that is to be played back through headphones, receive an indication of direct audio in the sound program, analyze the plurality of candidate BRIRs to determine a BRIR suitable for diffuse content and another BRIR suitable for direct content, select the BRIR suitable for diffuse content as a selected first BRIR, and select the BRIR suitable for direct content as a selected second BRIR, perform a first binaural rendering process on the diffuse audio to produce a plurality of first intermediate signals, wherein the first binaural rendering process applies the selected first BRIR and a first head related transfer function (HRTF) to the diffuse audio, perform a second binaural rendering process on the direct audio to produce a plurality of second intermediate signals, wherein the second binaural rendering process applies the selected second BRIR and a second HRTF to the direct audio, and combine the first and second intermediate signals to produce a plurality of combined headphone driver signals that are to drive the headphones.

12. The audio playback system of claim 11 wherein the instructions program the processor to perform the first and second binaural rendering processes in parallel, and wherein the first and second HRTFs are the same.

13. The audio playback system of claim 11 wherein the instructions program the processor to analyze the plurality of candidate BRIRs to select the selected first and second BRIRs, by classifying room acoustics of each candidate BRIR, extrapolating room geometry of each candidate BRIR, and extracting source directivity information from each candidate BRIR.

14. The audio playback system of claim 11 wherein the plurality of candidate BRIRs comprise a plurality of early reflection impulse responses and a plurality of late reflection impulse responses, wherein one of the plurality of late reflection impulse responses is associated with a room that is larger than a room that is associated with one of the early reflection impulse responses.

15. The audio playback system of claim 11 wherein the memory has stored therein further instructions that when executed by the processor track orientation of the headphones, wherein the second HRTF and the selected second BRIR are updated based on the tracked orientation of the headphones but the first HRTF and the selected first BRIR are not.

16. The audio playback system of claim 11 wherein the memory has stored therein a source model that specifies directivity and orientation of a sound source that would produce the sound represented by the direct audio and is independent of room characteristics, and instructions that when executed by the processor produce the second intermediate signals by processing the direct audio in accordance with the source model.

17. The audio playback system of claim 11 wherein the memory has stored therein instructions that when executed receive metadata associated with the sound program, wherein the metadata contains the indications of the diffuse and direct audio in the sound program.

18. An article of manufacture comprising:

a non-transitory machine readable storage medium having stored therein a plurality of candidate binaural room impulse responses (BRIRs) and instructions that when executed by a processor analyze the plurality of candidate BRIRs to determine a BRIR suitable for diffuse content and another BRIR suitable for direct content;

select the BRIR suitable for diffuse content as a selected first BRIR that is to be applied to diffuse audio, and select the BRIR suitable for direct content as a selected second BRIR that is to be applied to direct audio, perform a first binaural rendering process on the diffuse audio by applying the selected first BRIR and a first head related transfer function (HRTF) to the diffuse audio, perform a second binaural rendering process on the direct audio by applying the selected second BRIR and a second HRTF to the direct audio, and combining results of the first and second binaural rendering processes to produce a plurality of headphone driver signals that are to drive the headphones.

19. The article of manufacture of claim 18 wherein the first and second HRTFs are the same.

20. The article of manufacture of claim 18 wherein the diffuse audio and the direct audio overlap each other over time in a sound program that is to be played back through the headphones.

21. The article of manufacture of claim 18 wherein the instructions program the processor to analyze the plurality of candidate BRIRs to select the selected first and second BRIRs by analyzing and classifying number of channels or objects in a sound program that is being processed by the first and second binaural rendering processes, correlation between audio signals of the sound program over time, extraction of metadata associated with the sound program including genre of the sound program, to produce information about the sound program, and matching the sound program information with one or more of the candidate BRIRs.

22. The article of manufacture of claim 18 wherein the plurality of candidate BRIRs comprise a plurality of early reflection impulse responses and a plurality of late reflection impulse responses, wherein one of the plurality of late reflection impulse responses is associated with a room that is larger than a room that is associated with one of the early reflection impulse responses.

* * * * *